United States Patent [19]

Osborne

[11] 4,295,703

[45] Oct. 20, 1981

[54] CONNECTOR BLOCK

[75] Inventor: Brian T. Osborne, Kanata, Canada

[73] Assignee: Northern Telecom Limited, Montreal, Canada

[21] Appl. No.: 963,935

[22] Filed: Nov. 27, 1978

[51] Int. Cl.[3] ..... H01R 13/38

[52] U.S. Cl. ..... 339/98; 339/210 M

[58] Field of Search ..... 339/97 R, 97 P, 98, 339/99 R, 210 R, 210 M

[56] References Cited

U.S. PATENT DOCUMENTS 3,761,771 9/1973 Thompson et al. ..... 339/97 R 3,798,587 3/1974 Ellis, Jr. et al. ..... 339/97 P

*Primary Examiner*—Joseph H. McGlynn

*Attorney, Agent, or Firm*—Birch, Stewart, Kolasch & Birch

[57] ABSTRACT

A connector block for interconnecting two pluralities of wires fanned along the two opposite edges thereof is provided. The connector block has an elongate layered structure of three elements, a flat center element for supporting two staggered rows of flat, slotted electrical connectors, one on each surface thereof, and two insulating cover elements substantially coextensive, and compatible, with the center element, one on each side thereof and secured thereto for positively retaining the connectors in place. The center element is an insulator and has transversal slots in both of the opposite edges aligned with slots in the connectors for guiding and retaining wires to be inserted into the slots for establishing electrical contact therewith.

12 Claims, 21 Drawing Figures

CONNECTOR BLOCK

FIELD OF THE INVENTION

This invention relates to connector terminals of the insulation slicing type and more particularly to a novel connector block providing improved space utilization.

BACKGROUND AND PRIOR ART OF THE INVENTION

Quick-connect clip-type terminals or connectors are devices to circumvent previous wire connecting operations which required the time-consuming tasks of skinning, placing and connecting (see U.S. Pat. No. 3,112,147 issued Nov. 26, 1973 to W. Pferd, K. H. Pohl and D. W. Tyler). In the telephone industry, large numbers of wire terminations are made each year; with the advent of new business services, there is a rapid increase in the number of in-building interconnections. The increase in number and complexity of interconnections, if not accompanied by more efficient methods of accommodation, would result in an undue expansion in size. In mitigating such expansion in size and installation time of in-building interconnections, novel connectors and connector terminals have been developed.

Dunn et al in U.S. Pat. No. 4,002,391 issued Jan. 11, 1977 and in Canadian Pat. No. 1,029,109 issued Apr. 4, 1978, has improved upon the quick clip type connector (often termed simply quick clip). Such or similar quick clip connectors are suitable for use in the connector block of the present invention.

Connector blocks housing a number of quick clips are favoured in the telecommunications industry. Such connector blocks are used at distribution points for interconnecting feeder cable pairs and distribution cable pairs via jumper wires. These interconnections are not once-and-for-all connections. It is sometimes necessary to change interconnections to re-match physical cable pairs with subscriber numbers when subscribers change location.

Connector blocks have been disclosed in the prior art. In U.S. Pat. No. 3,798,587 to B. C. Ellis Jr. et al, two piece construction is used to house individual clip connectors. Two piece construction is also disclosed in U.S. Pat. No. 3,778,750 to Caveney et al. In the Ellis patent wires are laid in a mounting receptacle which accepts the connector block, the connector block is then mounted to make one side of the connections, thereafter the second series of wires is connected into the block. The Caveney connector block is bulky, having an approximate thickness of 1".

SUMMARY OF THE INVENTION

A connector block according to the present invention provide up to 50 individual connections in a block less than half an inch thick. Reduction is size is achieved by having two rows of clip type connectors in a single connector block by staggering one row with respect to the other. Advantageously, a single installation tool may be used for making all connections. In addition, slots to hold pairs in place during cable fanning operations are provided, thus allowing one side of the connections to be made in a single continuous operation.

Preferably, a connector block is constructed of thermoplastic material and has three components encasing two rows of connectors in a sandwich construction. A central element receives the connectors in the process of assembly and two cover elements are bonded to the center element.

Thus, in accordance with the present invention, there is provided an electrical connector block for interconnecting two pluralities of wires fanned along two opposite edges thereof, comprising: an elongate layered structure of three elements, a flat center element for supporting two staggered rows of flat, slotted, electrical connectors one on each surface thereof, and two insulating covers substantially coextensive, and compatible, with the center element, one on each side thereof and secured thereto, for positively retaining said connectors in place; said center element being an insulator having transversal slots in both of said opposite edges aligned with slots in said connectors for guiding and retaining wires to be inserted into the slots of said connectors for establishing electrical contact therewith.

The invention will be better understood by the following description of certain preferred embodiments in conjunction with the accompanying drawings in which.

DETAILED DESCRIPTION OF THE PREFERRED EMBODIMENT

Figure 1:
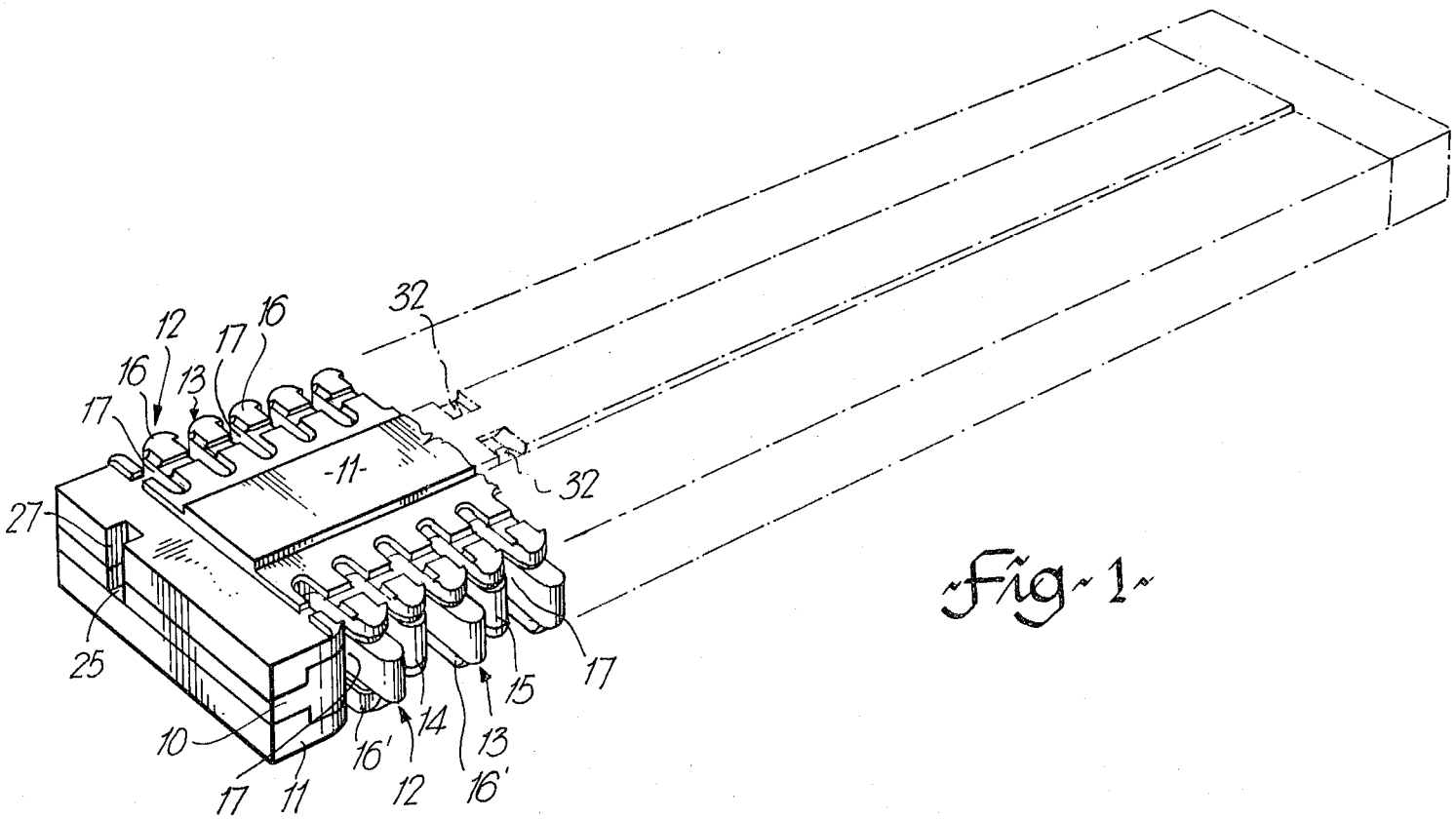
FIG. 1 is a perspective view of a portion of a connector block according to the present invention.

In the following description similar parts shown in different views are identified by the same reference numerals.

FIGS. 1, 2, 3 and 4 illustrate the complete assembly of one embodiment of the connector block according to the present invention. The connector block is a three-layer structure comprising a center element 10 and two cover elements 11 and 11'. A row of connectors 20 is disposed between the center element 10 and each of the cover elements 11 and 11'. The assembly has a flat elongate form with a comb-like profile on each edge with a plurality of laterally aligned tooth-like projections 12 and 13 alternately extending perpendicularly along each edge of the body of the connector. Each tooth-like projection 12 and 13 comprises a projection 14 or 15 from the center element 10 and two tooth-like projections 16 and 16' extending from the cover elements 11 and 11', respectively. The teeth 12 and 13 are uniformly spaced from one another and define slots 17 therebetween. The slots 17 provide access to the connectors 20 and provide support for the wires during the connection operation.

Figure 3:
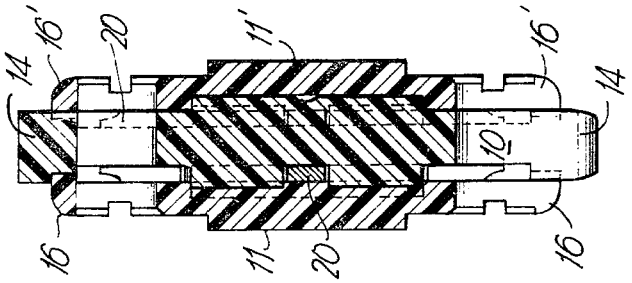
FIG. 3 is a cross-section of the connector block of FIG. 2 along the line 3—3 therein.
Figure 2:
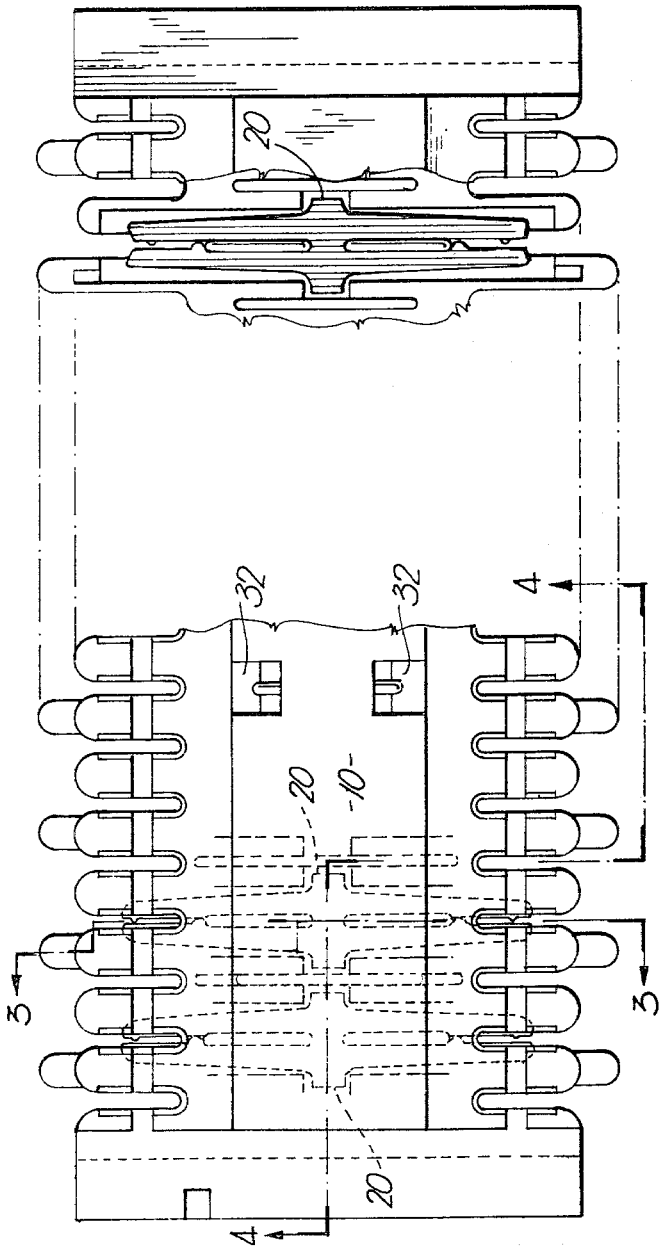
FIG. 2 is a top view of the connector block shown in FIG. 1 with the cover element partially broken away illustrating the location of a connector.
Figure 4:
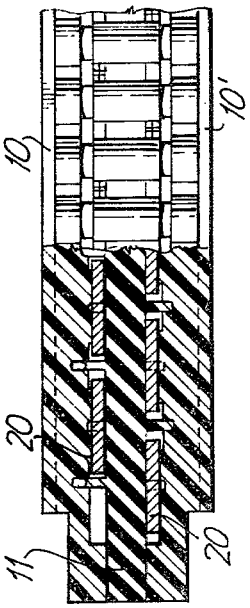
FIG. 4 is an edge view of the connector block of FIG. 2, partially broken away along the line 4—4 therein.

FIGS. 2, 3 and 4 illustrate how the connectors 20 are positioned in the connector block. As shown best in FIG. 4, the two rows of connectors 20 are staggered. This allows a large number of connections to be made in a relatively small area.

Figure 7:
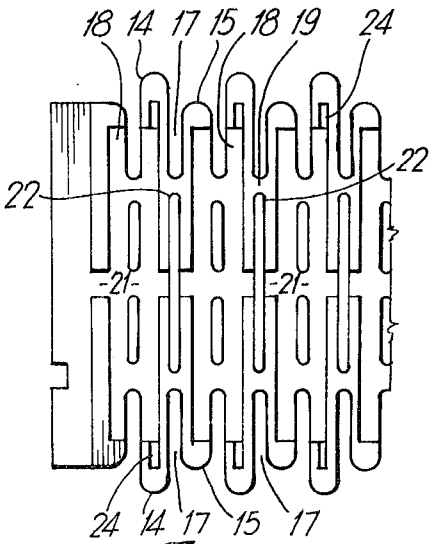
FIG. 7 is a partial plan view of the other side of the center element of FIG. 5.
Figure 5:
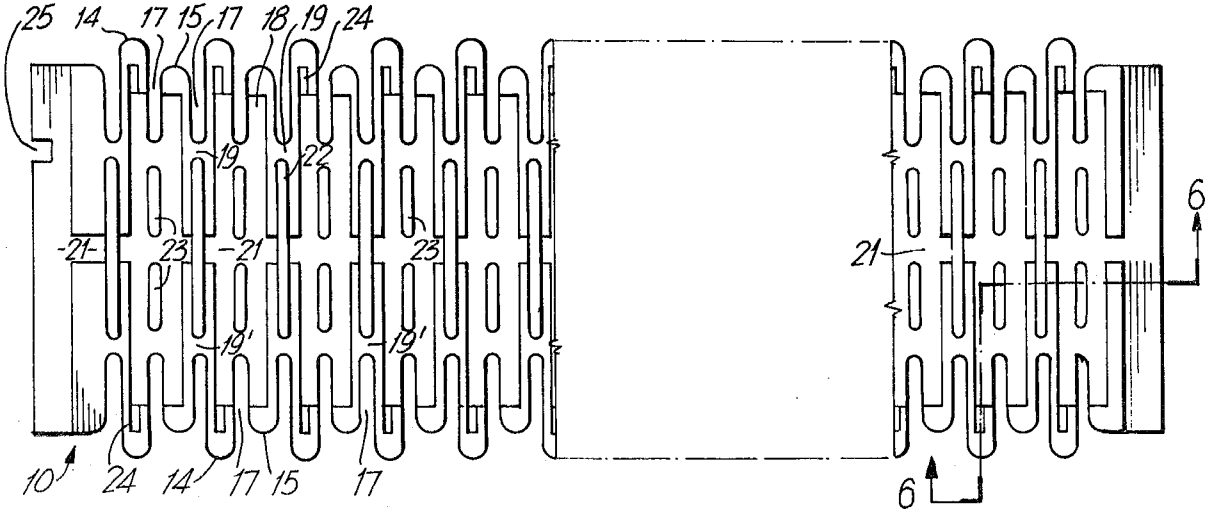
FIG. 5 is a plan view of a center element of the connector block of FIG. 1.
Figure 6:
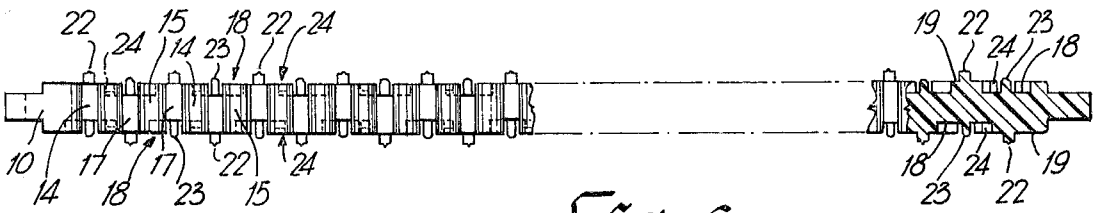
FIG. 6 is an edge view of the center element of FIG. 5 partially broken away along the line 6—6 therein.
Figure 8:
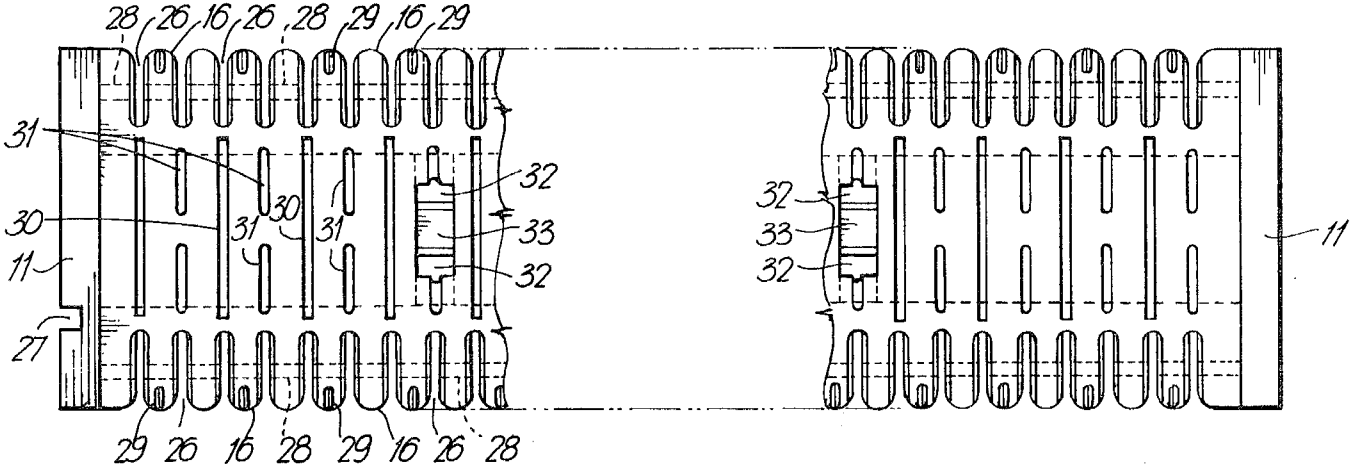
FIG. 8 is a side view of the inner side of the cover element in the connector block of FIG. 1.
Figure 9:
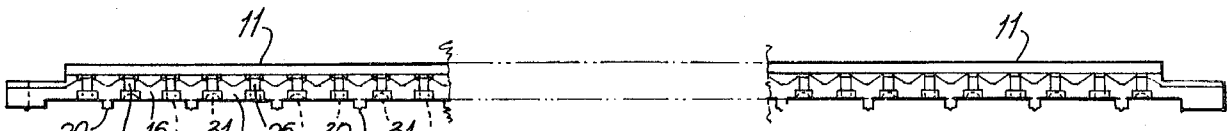
FIG. 9 is an edge view of the cover element of FIG. 8.

As illustrated in FIGS. 5, 6 and 7 a plurality of generally rectangular recesses 18 are disposed laterally aligned along the length of the center element 10 with the length of the rectangular recesses perpendicular to the length of the center element 10. Each recess 18 is centered longitudinally on alternate pairs of slots 17 and is of width to accept a connector 20. The depth of the recesses 18 is approximately equal to the thickness of the connector 20. Intermediate adjacent pairs of recesses 18 are lands 19 which extend from the edges of the center element 10 to a line parallel with the longitudinal axis of the center element 10 on each side thereof providing a central recess 21 along the length of the center element 10. Insulating ribs 22 extend longitudinally intermediate the recesses 18 along lands 19 across the central recess 21 and along land 19'. Locating ribs 23 are disposed along the longitudinal axis of each recess 18 one on each side of the longitudinal axis of the center element 18 and cooperate with locating slots 53 in clip connector 20.

Recess 24 located on land 19 between recess 18 and the end of tooth 14 cooperates with projections 29 on cover element 11 to assure alignment of the two elements. Key slot 25 is used for orientation.

FIG. 7 illustrates the other side of center element 10. It is substantially identical to the side shown in FIG. 5. Note that recesses 18 are centered on lands 19 on the other side of the center element such that the recesses 18 are in staggered relationship.

The center element 10 and the cover element 11 are preferably made of insulating thermoplastic resin. The cover element 11 has a thin elongate body of length and width generally corresponding to the length and width of the center element 10. Each edge of the cover element has a comb-like profile with teeth-like projections 16 extending therefrom. Defined between teeth 16 are slots 26 which are arranged so as to be in alignment with slots 17 in center element 10 when cover elements 11 are in place. Slots 26 are arranged in laterally aligned pairs and have a width somewhat less than slots 17. Thus wires are held in place by slots 26 allowing the fanning operation to be completed prior to inserting any of the wires into the connectors. Key slot 27 is used for alignment with key slot 25.

A groove 28 shown dotted across the outer surface of teeth 16 and is used for retaining test probes. Locating projections 29 which are disposed at the end of every second tooth 16 cooperate with recesses 24 on center element 10 to ensure alignment of the two elements and fuse during ultrasonic welding ensuring a tight bond. Grooves 30 are disposed perpendicularly to the longitudinal axis of the cover element being along its inner side to accept ribs 22 of center element 10. An additional pair of grooves 31 are disposed between grooves 30 along the length of the center element aligned to accept ribs 23 of center element 10. A pair of apertures 32 in the outer surface of cover element 11, inclined toward the longitudinal axis of the center element 10, open into a recess 33 on the inner surface and are used for securing a tie-wrap or the like to the connector block assembly.

Figure 10:
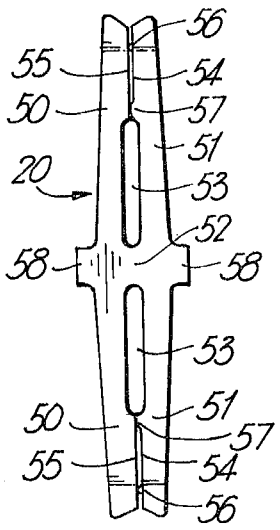
FIG. 10 is a view of an individual connector for one-to-one connections.
Figure 12:
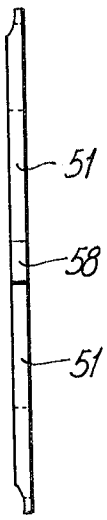
FIG. 12 is a side view of the connectors of FIGS. 10 and 11.
Figure 11:
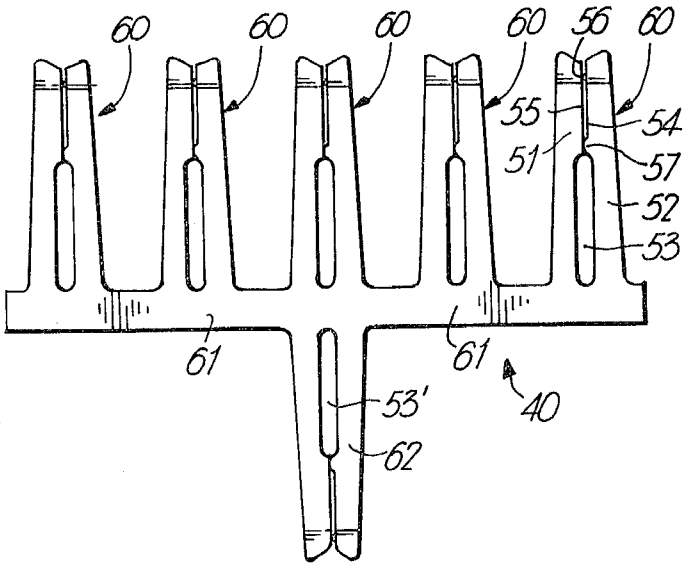
FIG. 11 is a view of a multiple connector for one-to-many connections.

The connectors used in conjunction with the present invention are illustrated in FIGS. 10, 11 and 12. The individual connector 20 of FIG. 10 has two pairs of oppositely extending opposed legs 50 and 51 extending from base portion 52. A pair of locating slots 53 defined between the legs 50 and 51 cooperate with locating ribs 23 in the center element 10. Cutting edges 54 and 55 are opposed and slice the insulation from a coated wire as it is inserted between the legs 50 and 51.

The connector 20 is produced by stamping or pressing from a continuous strip, the external profile and slots 53 being formed. The connector is then slit to form cutting edges 54 and 55 and then swaged to form swages 56 and 57. Swage 57 acts to prestress the legs 50 and 51 and swage 56 holds the conductor from slipping out of the connector. Tags 58 are remnants of the webs between adjacent clips as they are stamped from a continuous strip of conducting material and fit into central recess 21 of center element 10.

The multiple connector 40 of FIG. 11 is similar to the individual connector except that five single-ended connectors 60 are ganged together on webs 61 with one opposed single ended connector 62. The other features of the multiple connector 21 are identical to those of the individual connector 20. Multiple connectors are used in an alternate embodiment of the connector block of the invention to be described hereinafter.

Figure 13:
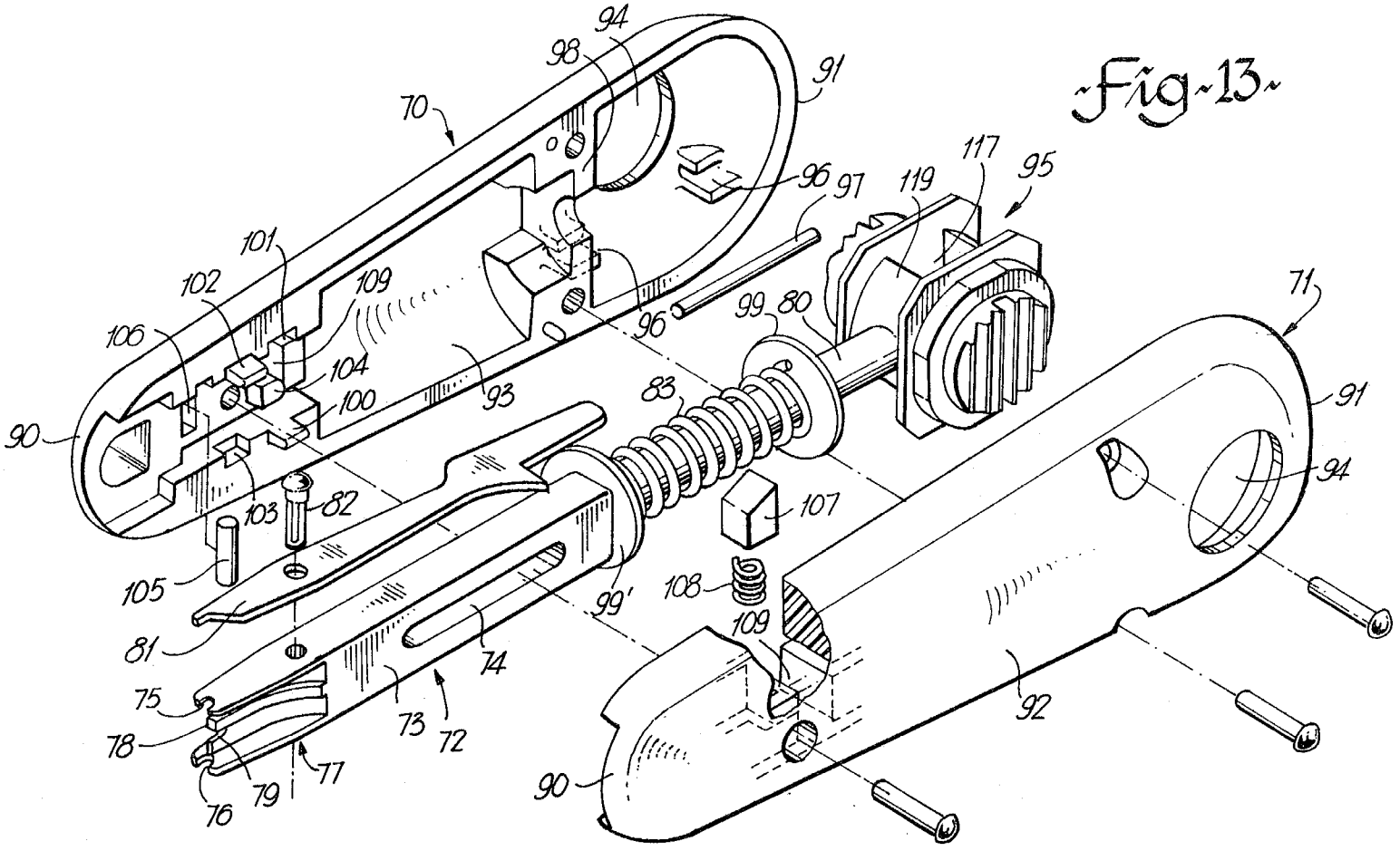
FIG. 13 is an exploded view of an installation tool for use in conjunction with the present invention.

FIG. 13 shows an exploded view of the insertion tool used for inserting the wires into the connecting block to make connection with the connector.

The tool comprises a pair of handle members 70 and 71 each identical. Each handle member is of a generally semi-cylindrical shape with one end 90 smaller than the other 91. The convex side 92 is outer side with the concave side 93 being the inner side. Near large end 91 is a circular cut-out 94 which accepts the knurled portion of disengage button 95, below the cut-out 94 on the inner side are a pair of spring retaining slots 96 which hold spring 97 which cooperates with disengage button 95 to give the button detent positions. Bulkhead 98 supports washer 99. Locating stubs 100 and 102 cooperate with depressions 101 and 103 on the other handle member. Tool head guide 104 fits into slot 74 on the tool head 72, dowel pin 105 fits into slot 106, and plunger 107 and plunger spring 108 fit into slot 109.

Tool head 72 is machined from a single block of suitable metal and comprises a body 73 rectangular cross-section having a longitudinal slot 74 machined through the sides, upper and lower wire guides 75 and 76, a wire insertion portion 77 which includes wire engaging portions 78 which has two recesses at 75, and a guide shaft 80 completes the tool head. Surrounding the shaft 80 is a compression spring 83 held in place by washers 99 and 99'. Cut-off blade 91 is attached to the tool head 72 by shoulder drive stud 82.

Figure 14:
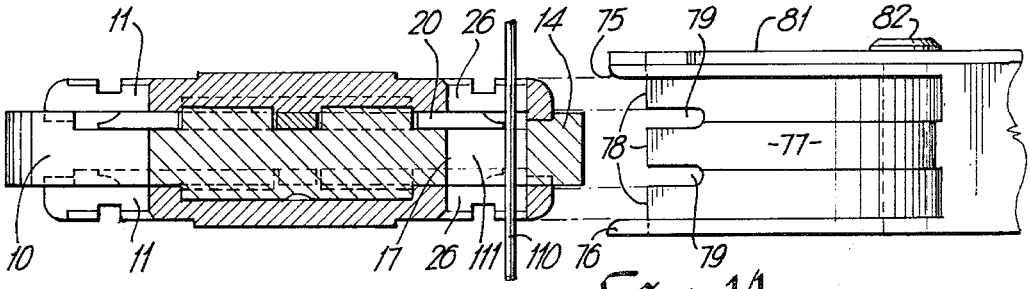
FIG. 14 is a cross-section of a connector block of the invention with a wire in place prior to insertion with the installation tool.
Figure 15:
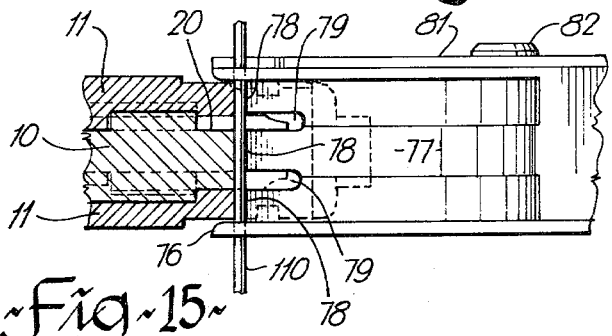
FIG. 15 is a view similar to FIG. 19 after installation by the installation tool but before its withdrawal.

Referring now to FIG. 14, the wire insertion portion 77 of the tool head 72 is shown in position to complete the insertion of a wire 110 previously inserted into slot 111. The tool head 72 moves to the left and is guided into the slot 111 formed by slots 26 in cover elements 11 and slot 17 in center element 10 of tooth 14 on center element 10. As the tool head moves further in the left, wire engaging portions 78 contact the wire 110 as do the wire guides 75 and 76. As well, wire guides 75 and 76 straddle the connector block providing for proper alignment of the tool vertically as shown in FIG. 15. The wire 110 is pushed into the connector 20 stripping away insulation in the process providing electrical contact between the wire and the connector 20. The recesses 79 are of a suitable depth to accommodate the connector 20 where it extends into the slot 111 without the wire insertion portion 77 physically contacting the connector 20.

Figure 16:
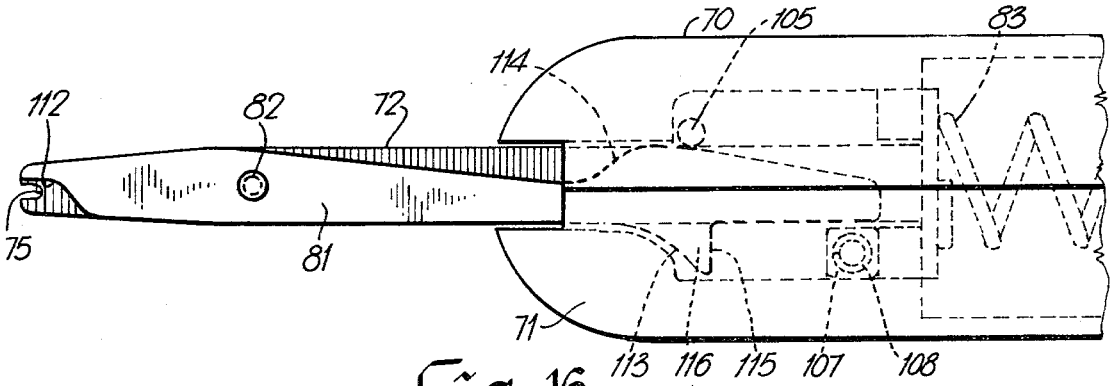
FIG. 16 is a top view of the installation tool showing its inner parts in broken lines.
Figure 17:
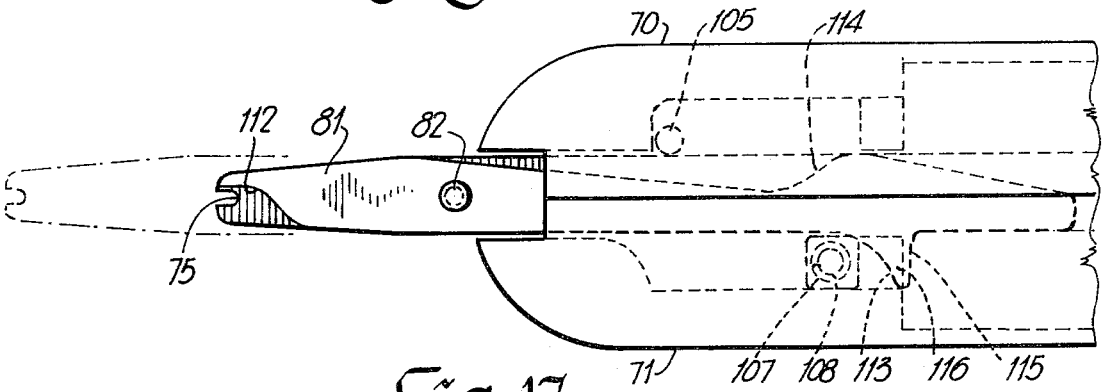
FIG. 17 is a view similar to FIG. 16 showing a portion of the tool head after the insertion of a wire into the connector block of the invention.
Figure 18:
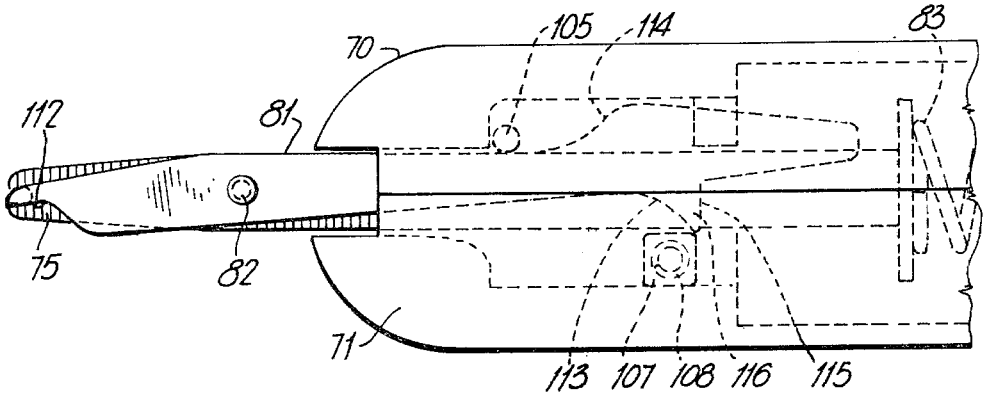
FIG. 18 is a similar to FIG. 17 showing the installation tool in shearing action.
Figure 21:
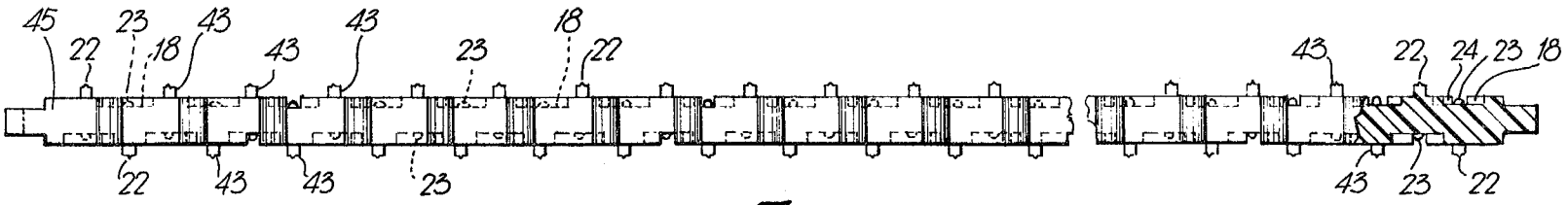
FIG. 21 is an edge view of the center element of FIG. 20.

FIGS. 16, 17 and 18 illustrate the shearing action of the insertion tool. FIG. 21 shows the tool in its normal position. Cut-off blade 81 has a cutting edge 112 at one end and two camming surfaces 113 and 114 at the other end on each side.

As a wire is inserted into a connector block the tool head 72 is pushed into the area between handle elements 70 and 71. During this time spring 83 is compressed. FIG. 17 illustrates that as the cut-off blade moves into the handle 70–71 butting surface 115 causes plunger 107 to compress plunger spring 108 due to its slanted surface (see FIG. 13) and eventually moves down such that the protrusion 116 slides over it. Once the protrusion 116 has moved past as the tool head 72 continues to move between the handle members 70–71 plunger 107 is resiliently forced by spring 108 back into its original position.

As the tool head 72 and blade 81 return out from between the handles 70–71 forced by spring 83, the blade 21 is forced by plunger 107 to cam on surface 113 and thus pivot on shoulder drive stud 82 causing cutting surface 112 to pass over wire guide 75 severing the wire 110.

As the tool head continues to move out of the handles 70–71, surface 114 cams on dowel pin 105 causing the blade 81 to pivot on shoulder drive pin stud 82 into the normal position.

When the cutting feature is not desired, disengage button 95 (see FIG. 13) may be rotated by 90° causing shaft 80 to butt against a surface 119 thereby not allowing tool head 72 to move into the handle elements 70–71, otherwise shaft 80 slides through hole 117 in disengage button 95.

Figure 19:
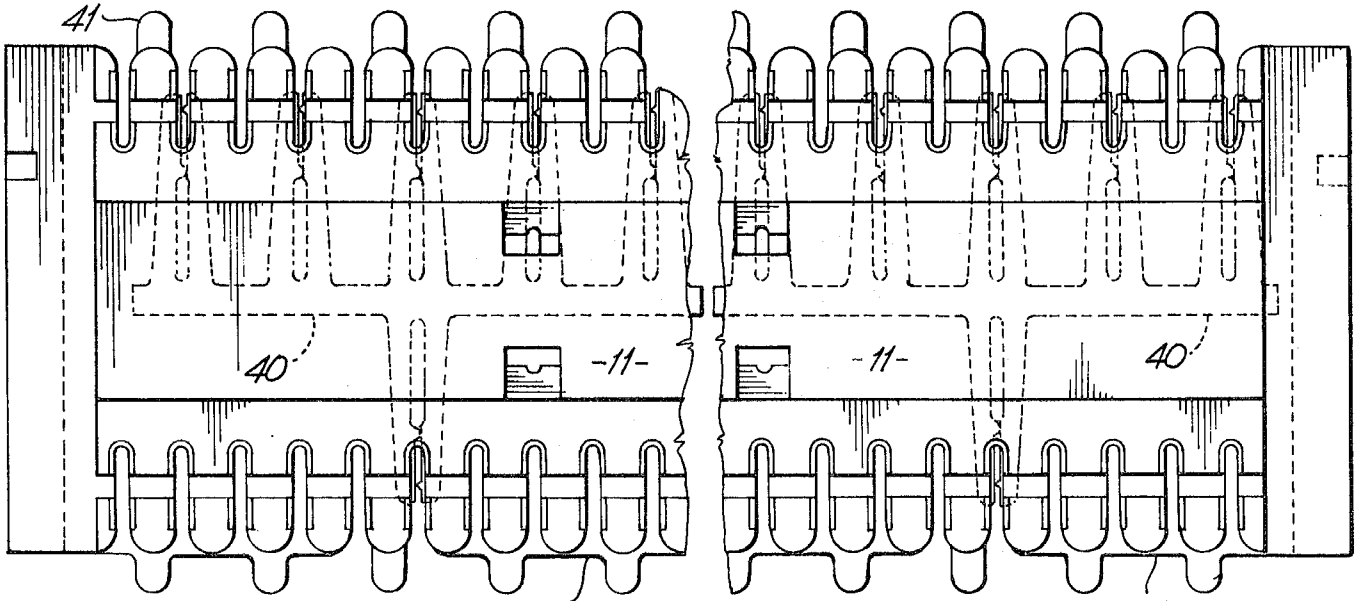
FIG. 19 is a side view of another embodiment wherein multiple connectors of FIG. 11 are utilized.
Figure 20:
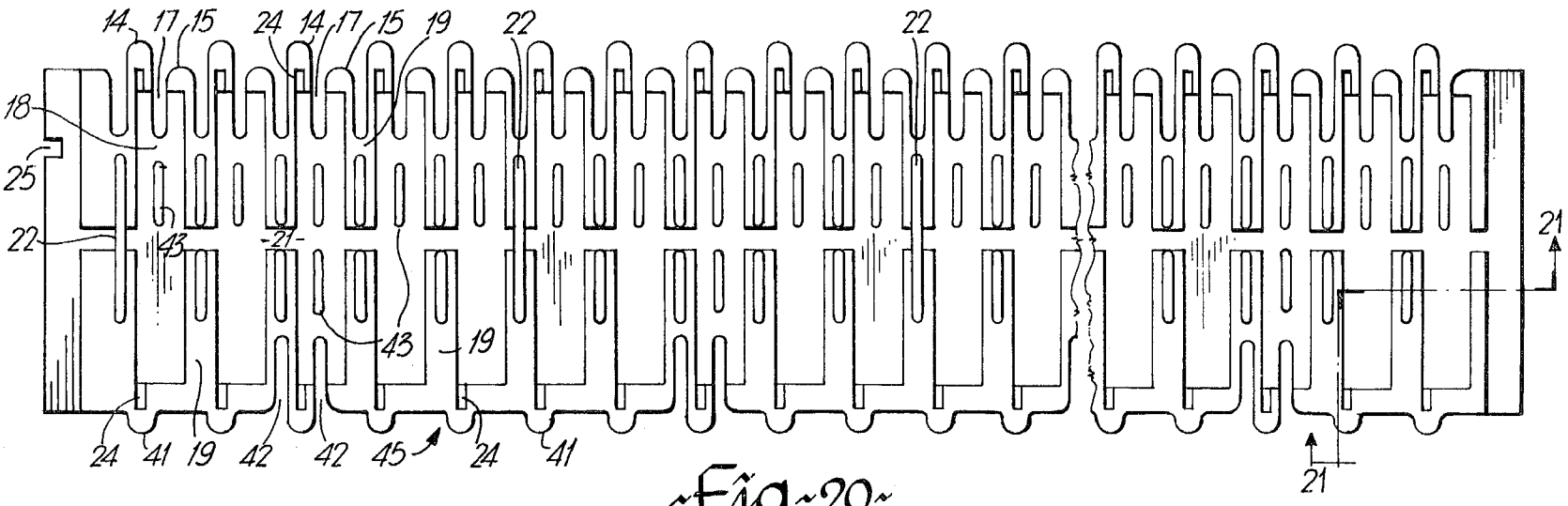
FIG. 20 is a side view of the center element of the embodiment of FIG. 19.

An alternate embodiment of the connector block of the invention is illustrated in FIG. 19. In this embodiment multiple connectors 40 (see FIG. 11) are disposed in two rows between center element 45 and cover elements 11 and 11'. As in the previous embodiment the two rows of multiple connectors are staggered to provide a large number of connectors in a small area.

The center element 45 is similar to center element 10. Center element 45 has the comb-like profile with teeth-like projections 14 and 15 alternately extending therefrom only on one edge which is identical to the edges of center element 10. On the other edge small teeth-like projections 41 protrude to match teeth 14. Slots 42 are provided for access to the one single end connector 62 of multiple connector 40, one for each side of the center element 45.

Insulating ribs 22 are found only every fifth recess so that the central recess 21 is left open to accept web 61 in connector 40. Insulating ribs 43 are provided on each land not having insulating rib 22. Locating ribs 23 are provided only where locating slots 53 will be when a connector 40 is in place.

Otherwise all the features of the center element 45 are identical to the center element 10.

It should be noted that any number of connectors ganged together with appropriate changes in the center element would not be beyond the scope of the present invention.

What is claimed is:

1. An electrical connector block for interconnecting two pluralities of wires fanned along two opposite edges thereof comprising:

an elongate layered structure of three elements, a flat center element for supporting two staggered rows of flat, slotted, electrical connectors one on each surface thereof, and two insulating covers substantially coextensive, and compatible, with the center element, one on each side thereof and secured thereto, for positively retaining said connectors in place; said center element being an insulator having transversal slots in both of said opposite edges aligned with slots in said connectors for guiding and retaining wires to be inserted into the slots of said connectors for establishing electrical contact therewith.

2. An electrical connector block as defined in claim 1, said center element being substantially rectangular and having two interleaved pluralities of comb-like teeth, one longer than the other, along each of said opposite edges, the teeth of said two interleaved pluralities defining said transversal slots, and said center element having two staggered rows of recesses, one in each of its two major surfaces, each row adapted to receive one of said two rows of flat electrical connectors.

3. An electrical connector block as defined in claim 2, said electrical connectors being bilaterally symmetrical and said electrical connectors insulated one from the other by projections in said center element.

4. An electrical connector block as defined in claim 3, said cover element being substantially compatible with said center element and having comb-like teeth partially overlaying the teeth in said center element.

5. An electrical connector block as defined in claim 4, said cover elements ultrasonically welded to said center element.

6. An electrical connector block as defined in claim 5, wherein said center element and said cover elements are molded from insulating thermoplastic material.

7. An electrical connector block as claimed in claim, said center element being substantially rectangular and having two interleaved pluralities of comb-like teeth along each of its longer edges, one projecting outwardly beyond the other, the teeth of said two interleaved pluralities defining said transversal slots, said slots aligned in pairs across the width of said center element:

a plurality of generally rectangular recesses disposed in lateral alignment along the length of both surfaces, the length of said recesses perpendicular to the length of said center element; each recess aligned on alternate pairs of said transversal slots; and each recess of width and depth to accept an electrical connector;

insulating ribs extending partially across said width, intermediate said recesses;

locating projections disposed centrally in each recess for cooperating with compatible apertures in said electrical connectors; and locating recesses for cooperating with compatible projections in said cover element.

8. An electrical connector block as defined in claim 7, said electrical connectors being bilaterally symmetrical.

9. An electrical connector block as claimed in claim 8, said cover element being substantially compatible with said center element and having an inner and an outer surface;

comb-like teeth along each of its longer edges partially overlaying the teeth in said center element;

grooves cooperating with the insulating ribs in said center element;

locating recesses disposed along the length of said inner surface cooperating with said locating projections; and projections on said inner surface cooperating with said locating recesses in said cover element.

10. An electrical connector block as claimed in claim 9, said cover elements ultrasonically welded to said center element.

11. An electrical connector block as claimed in claim 10, said center element and said cover elements being molded from insulating thermoplastic material.

12. An electrical connector block as claimed in claim 11, said electrical connectors being clip type connectors.

* * * * *